United States Patent [19]

Hastings

[11] 4,389,862

[45] Jun. 28, 1983

[54] HIGH SECURITY LOCKING ASSEMBLY FOR LOCKRODS TYPE REAR-END CLOSURES OF CARGO VEHICLES

[76] Inventor: Thomas M. Hastings, 9708 Valaretta Dr., Gretna, Nebr. 68028

[21] Appl. No.: 189,762

[22] Filed: Sep. 23, 1980

[51] Int. Cl.[3] ..... E05B 63/14; E05B 65/16; E05C 19/08; E05C 19/18

[52] U.S. Cl. ..... 70/2; 70/14; 70/18; 70/19; 70/54; 70/91; 70/101; 70/121; 292/44; 292/104; 292/205; 292/258; 292/283; 292/288; 292/DIG. 32

[58] Field of Search ..... 70/14, 19, 2, 101, 56, 70/54, 200, 199, 212, 211, 91, 18, 15, 203, 238, 121; 292/258, 288, 281, 31, 104, DIG. 32, 281–286, 44, 54, 56, 205

[56] References Cited

U.S. PATENT DOCUMENTS

| | | | |
|---|---|---|---|
| 929,774 | 8/1909 | Meyer et al. | 292/285 |
| 1,329,691 | 2/1920 | Anable | 70/18 |
| 1,393,022 | 10/1921 | Hughes | 70/200 |
| 1,395,970 | 11/1921 | Nidermaier | 70/19 |
| 1,439,111 | 12/1922 | Laney | 70/19 X |
| 1,639,870 | 8/1927 | Valsvig | 292/31 X |
| 1,803,084 | 4/1931 | Wiziarde et al. | 292/258 |
| 1,950,255 | 3/1934 | Maurer | 292/258 X |
| 2,151,587 | 3/1939 | Cassileth | 292/288 |
| 2,495,860 | 1/1950 | Miller | 292/258 |
| 2,846,257 | 8/1958 | Sherrill | 292/258 X |
| 2,851,870 | 9/1958 | Eckel | 70/101 |
| 2,899,229 | 8/1959 | Jenks | 292/288 |
| 3,328,064 | 6/1967 | Simon | 292/288 |
| 3,504,405 | 4/1970 | Elliott-Smith | 70/14 X |
| 3,550,409 | 12/1970 | Pariser | 70/238 X |
| 3,570,283 | 3/1971 | Males | 70/14 |
| 3,664,164 | 5/1972 | Zaidener | 70/14 X |
| 3,695,071 | 10/1972 | West | 70/18 UX |
| 3,924,426 | 12/1975 | Zane et al. | 70/18 |
| 4,003,227 | 1/1977 | Casey | 70/19 X |
| 4,322,102 | 3/1982 | Lindblom | 292/281 |

FOREIGN PATENT DOCUMENTS

| | | | |
|---|---|---|---|
| 967775 | 5/1976 | Canada | 70/18 |
| 371514 | 3/1923 | Fed. Rep. of Germany | 70/18 |
| 2307105 | 11/1976 | France | 292/DIG. 32 |
| 127020 | 12/1949 | Sweden | 70/14 |
| 135411 | 4/1952 | Sweden | 70/14 |
| 21904 | of 1905 | United Kingdom | 292/296 |
| 227884 | 1/1925 | United Kingdom | 292/281 |

*Primary Examiner*—Cornelius J. Husar
*Assistant Examiner*—Carl F. Pietruszka
*Attorney, Agent, or Firm*—George R. Nimmer

[57] ABSTRACT

The prevalent lockrods type rear-end closures for overland cargo carrying vehicles are exceedingly vulnerable to determined thievery. The high security locking assembly of the present invention is highly deterrent to thievery and comprises a hasp including a pair of J-shaped members respectively removably engaged with the two closure lockrods and having the apertured staple of the primary J-hook member cooperatively protruding through a slot of the secondary J-hook member. The two cooperating J-hook members are securely joinable with a padlock having its U-shaped bar passing through the protruding staple, and hence, protectively shrouded by the cooperating J-shaped members. When the lateral spacing of the lockrods is relatively close, the locking assembly prevents closure play as additional deterrent to thievery. The locking assembly will also accommodate relatively distant spacing of the lockrods and even if the two closure doors include a rearwardly protruding upright rib.

9 Claims, 9 Drawing Figures

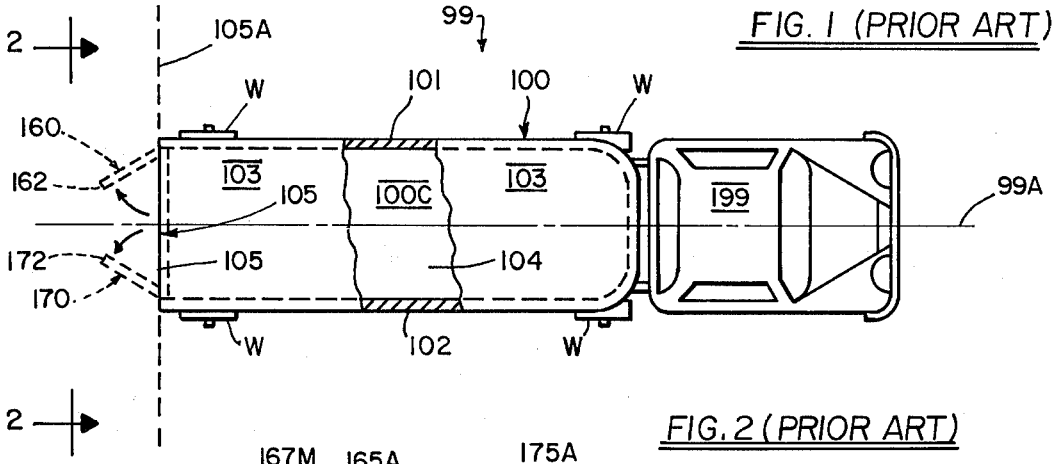
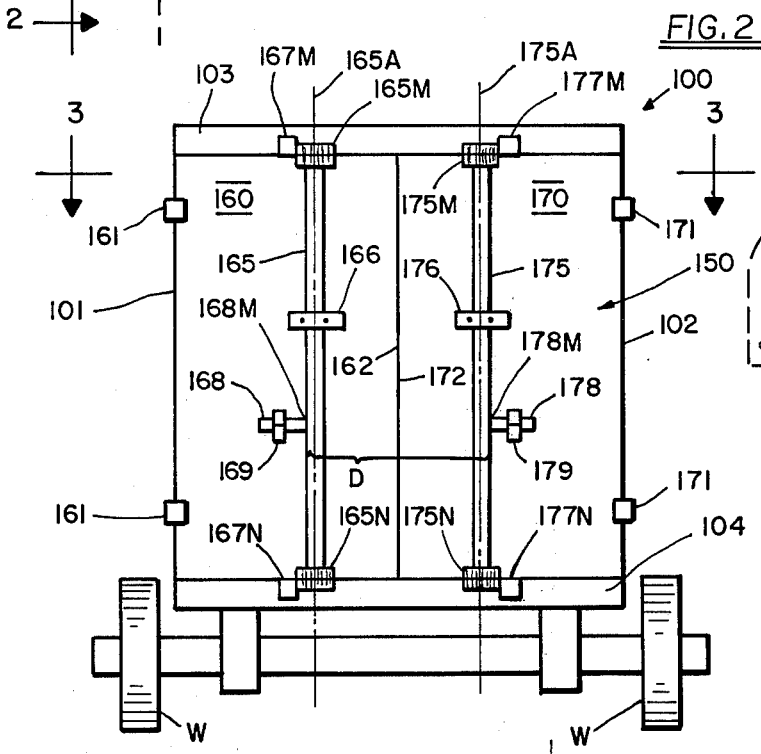
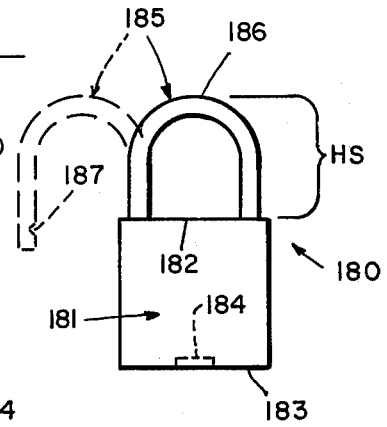
FIG. 3A (PRIOR ART)
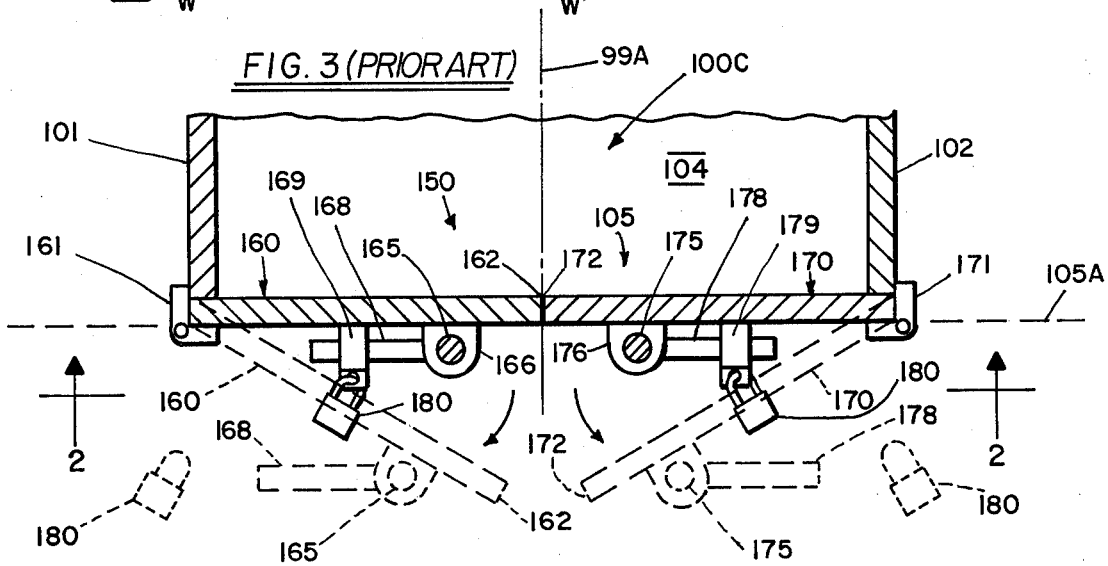

HIGH SECURITY LOCKING ASSEMBLY FOR LOCKRODS TYPE REAR-END CLOSURES OF CARGO VEHICLES

Cargo carrying vehicles that traverse public roadways are constantly subjected to the danger of cargo theft. Cargo theft most likely occurs when the truck vehicle is temporarily parked, such as when the vehicle operator digresses at a truck stop, a cafe, or at a public rest area. Moreover, cargo theft can even occur while the truck vehicle is actually traversing along a public roadway. Thieves are constantly devising ingenious new modus operandi to attain unauthorized entrance into the cargo compartment of overland vehicles, resulting in loss to the vehicle entrepreneur, to the vehicle insurance carrier, and indirectly to the public at large.

The overland trucking industry employs several varieties of closures permitting entrance for loading and unloading cargo into the vehicle cargo compartment. A prevalent type of cargo compartment closure is the trailer rear-end closure generally referred to as the "Lockrods type", and it is in removable combination with the "lockrods type" closure that the high security locking assembly of the present invention is employed. FIGS. 1, 2, and 3 of the drawing depict a typical style of "lockrods type" rear-end closure for cargo carrying vehicles, and illustrating in FIGS. 2 and 3 cargo vulnerability which challenged the inventor of the present invention.

FIG. 1 is a top plan view of a cargo loadable truck vehicle 99 comprising a self propelled tractor 199 ahead of a rearward trailer 100 extending in transverse direction along transverse-axis 99A. Trailer 100 includes underlying wheels "W", horizontal roof 103, horizontal floor 104, vertical first wall 101, vertical second wall 102, and rear end 105 laterally (105A) intersecting transverse axis 99A. FIG. 1 is partly in section to reveal cargo compartment 100C. FIG. 2 is a rear end elevational view taken along line 2—2 of FIG. 1 to reveal the rear end (105) upright closure 150 for cargo compartment 100C of trailer 100. "Lockrods type" closure 150 comprises a first door 160 (having upright free edge 162) hingedly attached at first hinges 161 to first wall 101, and analogously further comprises a second door 170 (having upright free edge 172) hingedly attached at second hinges 171 to second wall 102. Thus, as indicated in phantom lines in FIGS. 1 and 3, entrance into cargo compartment 100C is attainable only by moving the upright free edges 162 and 172 (and too the doors' attached upright lockrods 165 and 175) in the transverse (99A) rearward direction and laterally(105A) away from each other.

Upright first lockrod 165 extends along and is twistable about upright first-axis 165A, such as in first journal 166 attached to first door 160. Upright second lockrod 175 extends along and is twistable about upright second axis 175A, such as in second journal 176 attached to second door 170. First lockrod 165 has an upper cam 165M and a lower cam 165N, whereby as first lockrod 165 is made to twist about first axis 165A (as initiated by first handle 168) upper cam 165M is engageable and disengageable with top detent 167M carried by trailer roof 103 and lower cam 165N is simultaneously engageable and disengageable with bottom detent 167N carried by trailer floor 104. Second lockrod 175 has an upper cam 175M and a lower cam 175N, whereby as second lockrod 175 is made to twist about second axis 175A (as initiated by second handle 178) upper cam 175M is engageable and disengageable with top detent 177M carried by trailer roof 103 and lower cam 175N is simultaneously engageable and disengageable with bottom detent 177N carried by trailer floor 104. Thus, entrance into cargo compartment 100C, whether authorized or unauthorized, requires twisting of lockrods 165 and 175 about axes 165A and 175A and accompanied by movement of the doors' attached lockrods 165 and 175 in the transverse (99A) rearward direction and also laterally (105A) away from each other as indicated in FIGS. 1 and 3 in phantom lines.

In the quest to thwart unauthorized entrance into the cargo compartment 100C, prior art workers have primarily concentrated upon preventing twisting of lockrods 165 and 175 about axes 165A and 175A, such as by locking the handles 168 and 178 to first door 160 and to second door 170, respectively. For example, as indicated in FIGS. 2 and 3, first door 160 typically carries a seat 169 for removable engagment with first handle 168, and second door 170 typically carries a seat 179 for removable engagement with second handle 178. Conventional padlocks 180 are employed to lock first handle 168 into first door seat 169 and second handle 178 into second door seat 179. However, naked exposed padlocks 180 at seats 169 and 179 can be readily removed even by novice thieves. Prior art attempts to shield the padlocks 180 at seats 169 and 179, such as alluded to in U.S. Pat. No. 3,916,654, have had only limited success because thieves can shatter the juncture 168M between first handle 168 and first lockrod 165 and/or the juncture 178M between second handle 178 and second lockrod 175.

It is accordingly the general objective of the present invention to provide a high security locking assembly for the parting doors' (160, 170) rear end closure for cargo carrying vehicles and that overcomes the disadvantages and deficiencies of prior art locking means. It is an ancillary general objective to provide a high security locking assembly that does not depend merely upon preventing twisting of the lockrods about their respective axes (165A, 175A), but rather mutually restrains the doors' attached lockrods (165, 175) from moving away from each other and irrespective of the lockrods' lateral spacing.

With the above and other objects and advantages in view, which will become more apparent as this description proceeds, the high security locking assembly of the present invention generally comprises: a hasp including a pair of J-shaped members respectively removably engaged at their bights with the two parallel closure lockrods at the rear of a cargo carrying vehicle, the primary J-shaped member including an apertured staple removably protruding through a slot of the secondary J-shaped member, at least one, and preferably both, of the secondary member bars being provided with a plurality of laterally spaced upright slots to receive the primary member apertured hasp; and a padlock having its U-shaped shackle extending through the aperture of the protruding staple whereby said padlock maintains the primary and secondary J-hook members and their snugly engaged lockrods in laterally arrested relationship and with the shackle protectably shielded by the removably associated lofty primary and secondary members.

In the drawing, wherein like characters refer to like parts in the several views, and in which:

FIG. 1 is a top plan view of a typical overland cargo vehicle of the prior art with which the high security locking assembly of the present invention might be employed;

FIG. 2 is a sectional elevational view taken along lines 2—2 of FIGS. 1 and 3;

FIG. 3 is a sectional plan view taken along line 3—3 of FIG. 2;

FIG. 3A is an elevational view of a typical prior art padlock employable as a component of the present invention;

Figure 4:
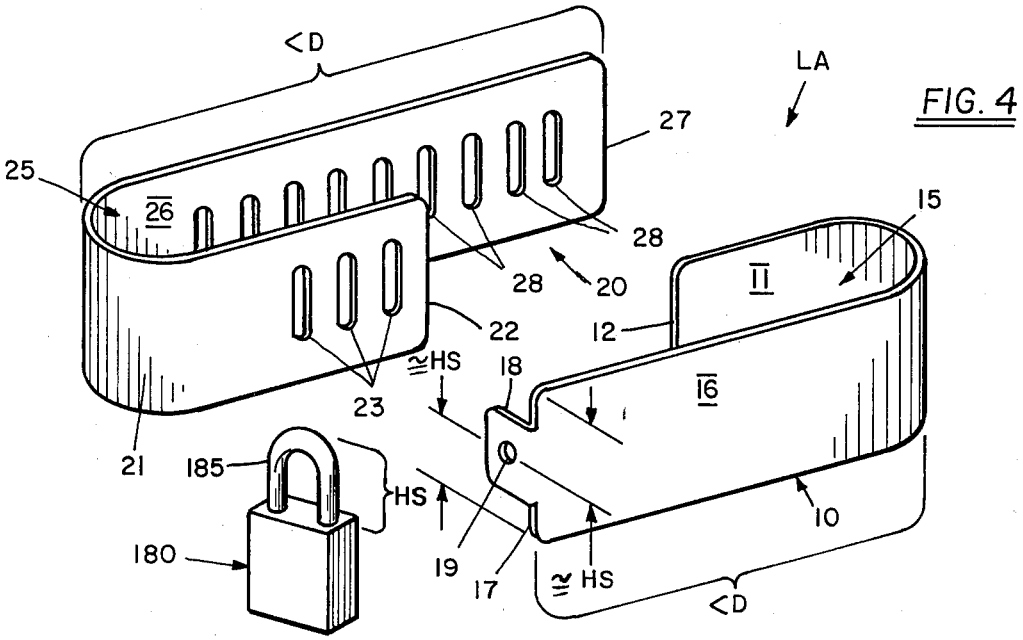
FIG. 4 is an exploded perspective view showing the tricomponents high security locking assembly in a preferred embodiment.

FIG. 4 depicts a representative embodiment of the three components providing the locking assembly "LA" for use in the typical environment depicted in FIGS. 1–3. The three components are: a a primary J-hook member (10) equipped with an apertured staple (18); a secondary J-hook member 20 adapted at one of a plurality of upright slots to cooperatively receive a protruding staple (18); and a conventional padlock (180) comprising a U-shaped shackle passing through the apertured staple whereby the padlock shackle 185 and body 181 are protected by the cooperating J-shaped members 10 and 20.

The loftily upright primary member e.g. 10, of locking assembly "LA" generally comprises a pair of directionally transversely separated parallel legs including a longer leg 16 attached to a shorter leg at the primary member curved bight 15 for there snugly removably engaging one of the two lockrods (165, 175). The longer leg 16, remote of bight 15, includes an apertured (19) staple 18 extending directionally transversely toward shorter leg 11. In elevation, the staple aperture 19 is located substantially midway the upright extent (i.e. 2×"HS") of the staplesite. Preferably, the staple is at the longer leg abrupt end 17. Desireably, the laterally extending length of longer bar 16 bears a ratio of at least two-thirds with respect to the lockrods' lateral spacing e.g. "D", "DD". Preferably, the primary member has a substantially constant upright-height (2×"HS") along both bars 11 and 16; in this vein, the entire primary member can be made from a single length of permanently bent metallic strap having abrupt ends 12 and 17. When installing the locking assembly "LA" onto a "lockrods type" closure environment 150, it is much more convenient (though not strictly necessary) to have the shorter leg 11 spaced transversely inwardly of the longer leg 16 whereby shorter leg 11 is the nearer to closure 150.

The loftily upright secondary member e.g. 20, of locking assembly "LA" generally comprises a pair of directionally transversely separated parallel legs including a lengthier leg 26 attached to a shorter leg 21 at secondary member curved bight 25 for snugly removably engaging the other one of the two lockrods. At least one of the two secondary member legs is provided with a plurality of laterally spaced upright slots e.g. 23, 28, to receive therethrough the apertured staple 18 of the primary member e.g. 10. For the installation technique of FIGS. 5 and 6, the arrested-bar requires slots (23). For the installation technique of FIGS. 7 and 8, the extended leg requires slots (28). However, for alternative adaption to both techniques, a single secondary member suffices wherein the arrested leg 21 has a plurality of slots 23 and the extended bar 26 has a more numerous plurality of slots 28. When slots 23 and 28 are employed within the same secondary member 20, slot spacing is preferably regular and equal on the respective legs 21 and 26. Desireably, the laterally extending length of extended leg 26 bears a ratio of at least two-thirds with respect to the lockrods lateral spacing e.g. "D", "DD". Preferably, the secondary member has a substantially constant height along both legs 21 and 26, which should not vary substantially from upright height "2×HS". However, to enhance clarity in FIGS. 6 and 8, the secondary member 20 is shown slightly loftier than primary member 10. Similarly as for primary member 10, the entire secondary member can be made from a single length of permanently bent metallic strap having abrupt ends 22 and 27.

The third component for the locking assembly "LA" is a conventional padlock, such as the typical prior art padlock 180 depicted in FIGS. 3A and 4. Such padlock types 180 comprise a body 181 having an upperside 182 and a lowerside 183 wherein is customarily located keyhole 184. Padlock types 180 also comprise a U-shaped shackle 185 extending a finite shackle height "HS" upwardly from body upperside 182 when the padlock is activated. (The deactivated shackle condition is shown in phantom line in FIG. 3A, wherein the shackle detent 187 can be seen). Desireably, the shackle height "HS" should not exceed about one-half the staplesite height which is substantially "2×HS". Thus, when the primary member hasp 18 protrudes through a selected slot (23, 28) of the secondary member, and the shackle 185 extends through the staple aperture 19, the activated padlock (180) maintains the lockrods-engaged members 10 and 20 in laterally arrested engagement while the padlock shackle 185 is shieldably protected against thievery by one or both of the lofty member 10, 20.

Figure 5:
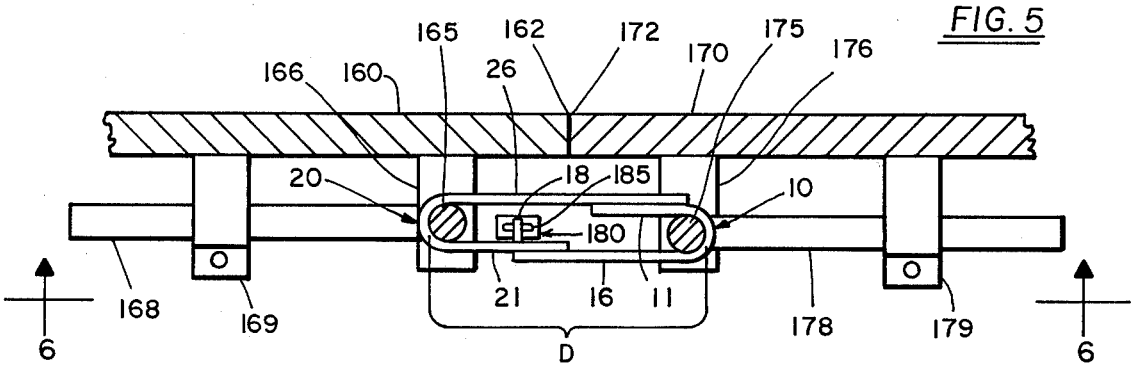
FIG. 5 is a sectional plan view showing the three components of FIG. 4 employed in an prior art environment wherein the lockrods' lateral spacing is relatively close.
Figure 7:
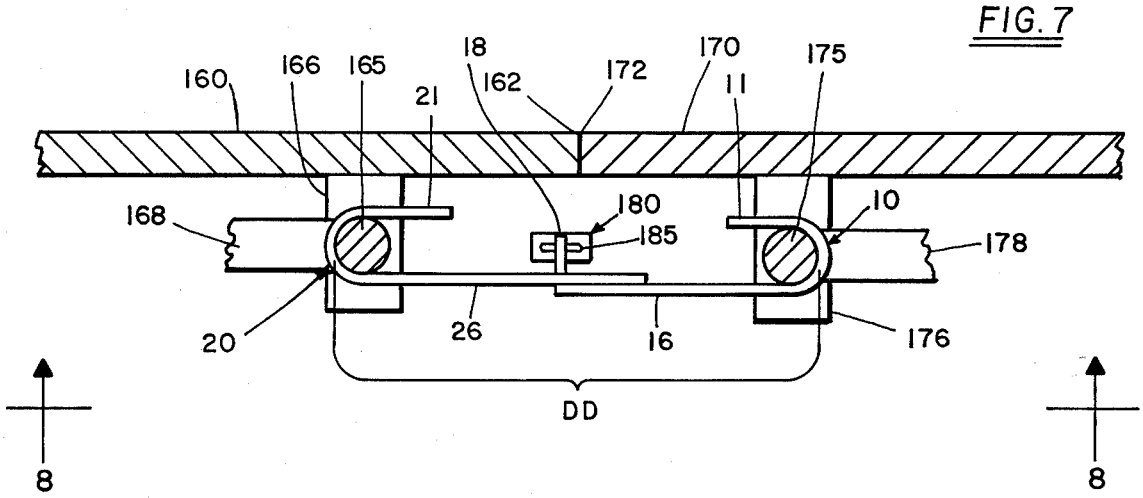
FIG. 7 is a sectional plan view, similar to FIGS. 3 and 5, showing the three components of FIG. 4 employed in a prior art environment wherein the lockrods' lateral spacing is relative great.
Figure 6:
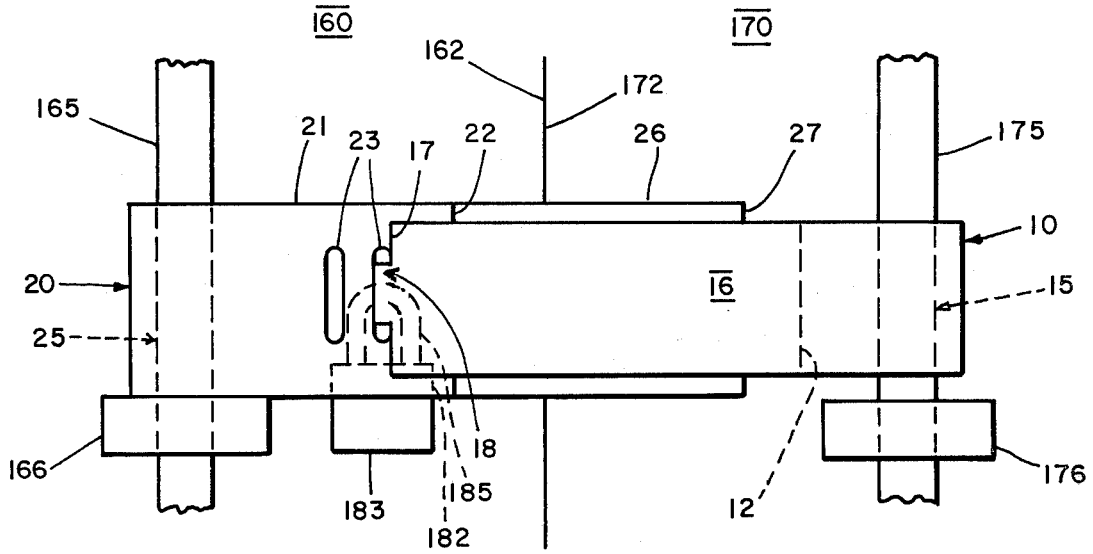
FIG. 6 is a sectional elevational view taken along line 6—6 of FIG. 5.
Figure 8:
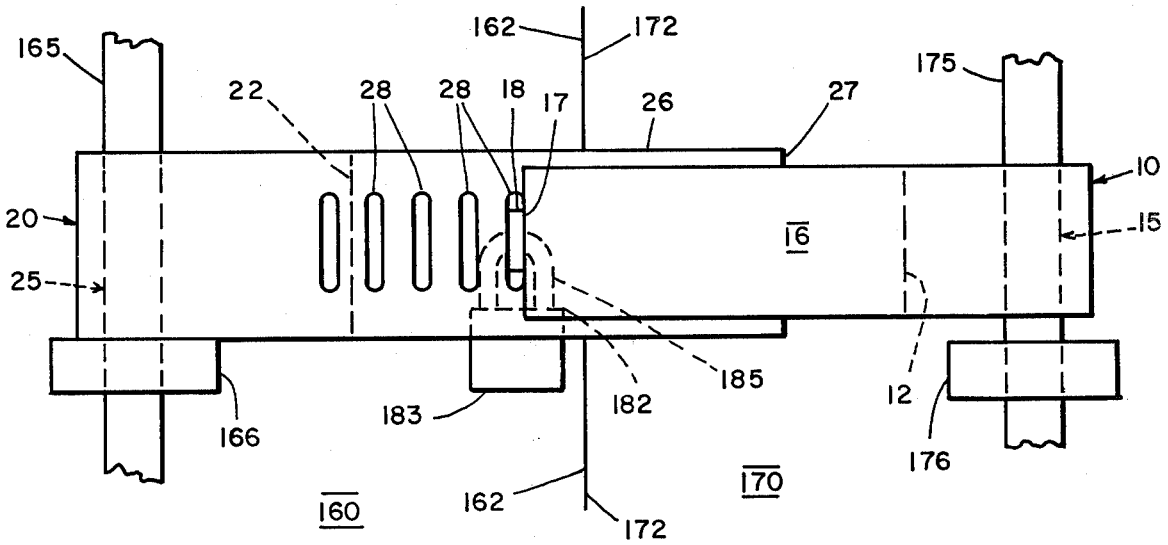
FIG. 8 is a sectional elevational view taken along line 8—8 of FIG. 7.

Turning now to FIGS. 5–8 showing two installation techniques for locking assembly "LA", FIGS. 5–6 being for the closure environment wherein the lockrods lateral spacing "D" is relatively close and FIGS. 7–8 being for the closure environment wherein the lockrods lateral spacing "DD" is relatively far and greater than "D".

To further promote cargo integrity, it is desireable to minimize closure play when the locking assembly "LA" is installed. This is attainable when the lateral spacing is a relatively close "D" value and when the closure doors at free edges 162 and 172 are free of transversely outwardly extending ribs, protrusions, etc. With such FIGS. 5–6 installation technique, which minimizes closure play, the plural slotted arrested leg 21 is in substantially co-planar abutting relationship with hasped longer leg 16, and the extended bar 26 is in substantially co-planar abutting relationship with shorter leg 11. With this technique, staple 18 protrudes through a slot 23 of arrested leg 21, the slot 23 being selected that will minimize the lateral spacing between the bights 15 and 25.

With the FIGS. 7 and 8 installation technique previously alluded to, hasp 18 protrudes through a selected slot of extended leg 26, the slot 28 being selected that will minimize the lateral spacing between the bights 15 and 25. Thus, the plural slots extended leg 26 is in co-planar and abutting relationship with the staple equipped longer leg 16. Moreover, the shorter bar 11 and the arrested bar 21 are in substantially co-planar and non-abutting relationship, there being a laterally extending gap less than "DD" between leg ends 12 and 22. It is necessary for the FIGS. 7–8 installation technique to have the shorter leg 11 and the arrested bar 21 located directionally transversely inwardly of abutting legs 16 and 26 whereby said relatively transversely outward legs 11 and 26 shieldably protect padlock shackle 185.

From the foregoing, the construction and operation of the lockrods locking assembly will be readily understood and further explanation is believed to be unnecessary. However, since numerous modifications and changes will readily occur to those skilled in the art, it is not desired to limit the invention to the exact construction shown and described, and accordingly, all suitable modifications and equivalents may be resorted to, falling within the scope of the appended claims.

I claim:

1. In removable combination with a cargo carrying vehicle wherein the closure therefor comprises a pair of upright lockrods having a finite lateral-spacing at closed condition, the lockrods being relatively laterally movable whereby entrance into the cargo compartment is attainable only by moving one lockrod laterally away from the other lockrod, a high security locking assembly for said cargo compartment closure and comprising:

A. an upright primary J-hook member including a relatively long leg attached to a parallel and directionally transversely separated relatively short leg attached at a curved bight for snugly removably engaging one of said lockrods, the longer leg remote of the bight carrying an upright apertured staple extending directionally transversely toward the shorter leg;

B. an upright secondary J-hook member including a relatively long leg attached to a parallel and directionally transversely separated relatively short leg attached at a curved bight for snugly removably engaging the other lockrod, at least one of the legs of the secondary member being provided with a plurality of regularly spaced upright slots, one of which receives therethrough the apertured staple of the primary member; and C. a padlock of the type comprising a body and a U-shaped shackle and a body, said padlock is activated condition having its shackle extending through the aperture of the staple with the member legs in substantially parallel assembled relation, whereby said padlock maintains the primary and secondary J-hook members and their engaged lockrods in arrested relationship and whereby the padlock is protectably shielded by the removably associated primary and secondary J-hook members.

2. The combination of claim 1 wherein both legs of the secondary J-hook member are provided with a plurality of laterally spaced upright slots, the number of slots through the longer leg exceeding the number of slots through the shorter leg.

3. The combination of claim 2 wherein the lateral spacing of the slots is regular and substantially equal on both legs.

4. The combination of claim 3 wherein the staple extends through a selected upright slot of the secondary member shorter leg whereby said secondary member shorter leg is in substantially co-planar abutting relationship with the longer leg of the of the primary member, and the longer leg of the secondary member is in substantially co-planar abutting relationship with the shorter leg of the primary member, said two abutting relationships minimizing closure play when the locking assembly is being employed.

5. The locking assembly of claim 1 wherein the primary member has a substantially constant finite upright-height along both legs.

6. The locking assembly of claim 5 wherein the primary member and the secondary member are fabricated from permanently bent metallic straps.

7. The combination of claim 1 wherein the staple extends through a selected slot of the secondary member longer leg, said leg being in substantially co-planar and abutting relationship with the primary member longer leg; and wherein the two shorter legs are in substantially co-planar and non-abutting relationship, there being a laterally extending gap between said two shorter legs, and all four said legs being substantially planar.

8. The combination of claim 7 wherein the laterally extending length of each longer leg bears a ratio within the range of about two-thirds to nine-tenths the lockrods finite lateral-spacing.

9. The combination of claim 1 wherein each lockrod is rotatably secured to the closure with a loftily elevated journal; and wherein the locking assembly is maintained at relatively high elevation by at least one of the lockrod journals.

* * * * *